US008038528B2

(12) United States Patent
Englman et al.

(10) Patent No.: US 8,038,528 B2
(45) Date of Patent: Oct. 18, 2011

(54) WAGERING GAME WITH ENHANCED PROGRESSIVE GAME

(75) Inventors: Allon G Englman, Chicago, IL (US); Michael W. Mastropietro, Chicago, IL (US); Peter R. Anderson, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 761 days.

(21) Appl. No.: 11/587,547

(22) PCT Filed: May 17, 2005

(86) PCT No.: PCT/US2005/017327

§ 371 (c)(1),
(2), (4) Date: Oct. 25, 2006

(87) PCT Pub. No.: WO2005/113093

PCT Pub. Date: Dec. 1, 2005

(65) Prior Publication Data

US 2008/0015012 A1 Jan. 17, 2008

Related U.S. Application Data

(60) Provisional application No. 60/572,294, filed on May 18, 2004, provisional application No. 60/635,336, filed on Dec. 10, 2004, provisional application No. 60/639,952, filed on Dec. 22, 2004.

(51) Int. Cl.
*A63F 9/24* (2006.01)

(52) U.S. Cl. ..... 463/25; 463/16; 463/20

(58) Field of Classification Search ..... 463/16–20, 463/25–27, 30, 42; 273/274
See application file for complete search history.

(56) References Cited

U.S. PATENT DOCUMENTS 4,624,459 A 11/1986 Kaufman ..... 273/143 R
4,837,728 A * 6/1989 Barrie et al. ..... 463/27
4,861,041 A 8/1989 Jones et al. ..... 273/292

(Continued)

FOREIGN PATENT DOCUMENTS

CA 2 334 546 8/2001

(Continued)

OTHER PUBLICATIONS

Article for "Easy Riches" by Sigma Game, Strictly Slots, 1 page (Aug. 2001).

(Continued)

*Primary Examiner* — Masud Ahmed
(74) *Attorney, Agent, or Firm* — Nixon Peabody LLP

(57) ABSTRACT

A method of playing a wagering game, the wagering game having a basic game and a multi-level secondary game. The method includes conducting the basic game at a gaming terminal. In response to achieving a first-level secondary game entry award, a first-level secondary game is activated. A first set of player-selectable game elements is displayed during the first level secondary game and a player selects, at least one of the first set of player-selectable game elements, which include at least one second-level secondary game entry award. Upon selecting the second-level secondary game entry award, a second-level secondary game is activated and a second set of player-selectable game elements are displayed. The player selects at least one of the second set of player-selectable game elements and a progressive game payoff is awarded based on the selecting.

25 Claims, 7 Drawing Sheets

U.S. PATENT DOCUMENTS

| | | | | |
|---|---|---|---|---|
| 4,948,134 | A | 8/1990 | Suttle et al. | 273/85 |
| 5,116,055 | A | 5/1992 | Tracy | 273/138 A |
| 5,249,800 | A | 10/1993 | Hilgendorf et al. | 273/138 A |
| 5,275,400 | A | 1/1994 | Weingardt et al. | 463/12 |
| 5,280,909 | A | 1/1994 | Tracy | 273/138 A |
| 5,344,144 | A | 9/1994 | Canon | 273/138 A |
| 5,377,973 | A | 1/1995 | Jones et al. | 273/85 CP |
| 5,393,057 | A | 2/1995 | Marnell, II | 273/85 CP |
| 5,417,430 | A | 5/1995 | Breeding | 273/292 |
| 5,524,888 | A | 6/1996 | Heidel | 463/22 |
| 5,544,892 | A | 8/1996 | Breeding | 273/292 |
| 5,560,603 | A * | 10/1996 | Seelig et al. | 463/6 |
| 5,564,700 | A | 10/1996 | Celona | 463/27 |
| 5,577,959 | A | 11/1996 | Takemoto | 463/25 |
| 5,580,063 | A | 12/1996 | Edwards | 273/378 |
| 5,580,309 | A | 12/1996 | Piechowiak et al. | 463/16 |
| 5,611,730 | A | 3/1997 | Weiss | 463/20 |
| 5,645,486 | A | 7/1997 | Nagao et al. | 463/27 |
| 5,647,592 | A | 7/1997 | Gerow | 463/139 |
| 5,655,961 | A | 8/1997 | Acres et al. | 463/27 |
| 5,766,076 | A | 6/1998 | Pease et al. | 463/27 |
| RE35,864 | E | 7/1998 | Weingardt | 463/28 |
| 5,779,549 | A | 7/1998 | Walker et al. | 463/42 |
| 5,816,918 | A | 10/1998 | Kelly et al. | 463/16 |
| 5,820,459 | A | 10/1998 | Acres et al. | 463/25 |
| 5,823,874 | A | 10/1998 | Adams | 463/17 |
| 5,839,956 | A | 11/1998 | Takemoto | 463/25 |
| 5,848,932 | A | 12/1998 | Adams | 463/20 |
| 5,851,147 | A | 12/1998 | Stupak | 463/13 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,944,606 | A | 8/1999 | Gerow | 463/27 |
| 5,951,011 | A | 9/1999 | Potter et al. | 273/292 |
| 5,976,015 | A * | 11/1999 | Seelig et al. | 463/6 |
| 6,003,013 | A | 12/1999 | Boushy et al. | 705/10 |
| 6,007,427 | A | 12/1999 | Wiener et al. | 463/17 |
| 6,012,982 | A | 1/2000 | Piechowiak et al. | 463/16 |
| 6,032,955 | A | 3/2000 | Luciano et al. | 273/138.1 |
| 6,047,963 | A | 4/2000 | Pierce et al. | 273/121 B |
| 6,077,162 | A * | 6/2000 | Weiss | 463/26 |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,799 | A | 8/2000 | Stupak | 463/27 |
| 6,110,043 | A | 8/2000 | Olsen | 463/27 |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A | 12/2000 | Giobbi et al. | 463/20 |
| 6,158,741 | A | 12/2000 | Koelling | 273/292 |
| 6,159,097 | A | 12/2000 | Gura | 463/20 |
| 6,168,523 | B1 | 1/2001 | Piechowiak et al. | 463/26 |
| 6,203,010 | B1 | 3/2001 | Jorasch et al. | 273/138.1 |
| 6,206,374 | B1 | 3/2001 | Jones | 273/292 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 * | 5/2001 | Okuda et al. | 463/27 |
| 6,231,445 | B1 | 5/2001 | Acres | 463/42 |
| 6,241,608 | B1 | 6/2001 | Torango | 463/27 |
| 6,254,483 | B1 | 7/2001 | Acres | 463/26 |
| 6,312,332 | B1 | 11/2001 | Walker et al. | 463/23 |
| 6,315,660 | B1 | 11/2001 | DeMar et al. | 463/16 |
| 6,319,125 | B1 | 11/2001 | Acres | 463/25 |
| 6,319,127 | B1 | 11/2001 | Walker et al. | 463/26 |
| 6,336,859 | B2 | 1/2002 | Jones et al. | 463/13 |
| 6,336,862 | B1 | 1/2002 | Byrne | 463/27 |
| 6,345,824 | B1 | 2/2002 | Selitzky | 273/292 |
| 6,354,593 | B1 * | 3/2002 | Frommer et al. | 273/274 |
| 6,358,149 | B1 | 3/2002 | Schneider et al. | 463/27 |
| 6,361,441 | B1 | 3/2002 | Walker et al. | 463/42 |
| 6,364,768 | B1 | 4/2002 | Acres et al. | 463/25 |
| 6,375,567 | B1 | 4/2002 | Acres | 463/25 |
| 6,375,568 | B1 | 4/2002 | Roffman et al. | 463/26 |
| 6,416,409 | B1 | 7/2002 | Jordan | 463/27 |
| 6,431,983 | B2 | 8/2002 | Acres | 463/25 |
| 6,435,968 | B1 | 8/2002 | Torango | 463/27 |
| 6,439,995 | B1 | 8/2002 | Hughs-Baird et al. | 463/20 |
| 6,482,089 | B2 | 11/2002 | DeMar et al. | 463/20 |
| 6,506,117 | B2 | 1/2003 | DeMar et al. | 463/20 |
| 6,508,707 | B2 | 1/2003 | DeMar et al. | 463/16 |
| 6,517,433 | B2 | 2/2003 | Loose et al. | 463/20 |
| 6,520,855 | B2 | 2/2003 | DeMar et al. | 463/20 |
| 6,577,733 | B1 | 6/2003 | Charrin | 380/251 |
| 6,589,115 | B2 | 7/2003 | Walker et al. | 463/25 |
| 6,592,458 | B1 | 7/2003 | Ho | 463/17 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,601,771 | B2 | 8/2003 | Charrin | 235/492 |
| 6,607,437 | B2 * | 8/2003 | Casey et al. | 463/16 |
| 6,648,762 | B2 | 11/2003 | Walker et al. | 463/25 |
| 6,656,052 | B2 | 12/2003 | Abramopoulos et al. | 463/47 |
| 6,676,513 | B2 | 1/2004 | Gauselmann | 463/20 |
| 6,712,695 | B2 | 3/2004 | Mothwurf et al. | 463/25 |
| 6,733,390 | B2 | 5/2004 | Walker et al. | 463/23 |
| 6,776,715 | B2 | 8/2004 | Price | 463/27 |
| 6,887,154 | B1 | 5/2005 | Luciano, Jr. et al. | 463/26 |
| 7,004,466 | B2 | 2/2006 | Gauselmann | 463/138 |
| 7,036,012 | B2 | 4/2006 | Charrin | 713/169 |
| 7,056,215 | B1 | 6/2006 | Olive | 463/27 |
| 2002/0049084 | A1 * | 4/2002 | Hughs-Baird et al. | 463/20 |
| 2002/0138594 | A1 | 9/2002 | Rowe | 709/219 |
| 2002/0151345 | A1 | 10/2002 | Byrne | 463/18 |
| 2002/0155874 | A1 | 10/2002 | Byrne | 463/16 |
| 2003/0008705 | A1 * | 1/2003 | Baerlocher et al. | 463/20 |
| 2003/0014370 | A1 | 1/2003 | Charrin | 705/65 |
| 2003/0027618 | A1 | 2/2003 | Byrne | 463/16 |
| 2003/0027625 | A1 | 2/2003 | Rowe | 463/20 |
| 2003/0036430 | A1 | 2/2003 | Cannon | 463/42 |
| 2003/0045337 | A1 | 3/2003 | Byrne | 463/16 |
| 2003/0045348 | A1 * | 3/2003 | Palmer et al. | 463/25 |
| 2003/0050106 | A1 | 3/2003 | Lyfoung | 463/13 |
| 2003/0060266 | A1 | 3/2003 | Baerlocher | 463/20 |
| 2003/0064776 | A1 | 4/2003 | Byrne | 463/16 |
| 2003/0100358 | A1 * | 5/2003 | Kaminkow | 463/20 |
| 2003/0109306 | A1 | 6/2003 | Karmarkar | 463/40 |
| 2003/0119573 | A1 * | 6/2003 | McClintic | 463/16 |
| 2003/0148807 | A1 * | 8/2003 | Acres | 463/26 |
| 2003/0148808 | A1 | 8/2003 | Price | 463/27 |
| 2003/0181231 | A1 * | 9/2003 | Vancura et al. | 463/9 |
| 2003/0186733 | A1 | 10/2003 | Wolf et al. | 463/16 |
| 2003/0211884 | A1 | 11/2003 | Gauselmann | 463/20 |
| 2003/0216166 | A1 | 11/2003 | Baerlocher et al. | 463/20 |
| 2003/0222402 | A1 | 12/2003 | Olive | 273/292 |
| 2003/0228899 | A1 | 12/2003 | Evans | 463/25 |
| 2003/0236116 | A1 | 12/2003 | Marks et al. | 463/16 |
| 2004/0009808 | A1 | 1/2004 | Gauselmann | 463/25 |
| 2004/0009811 | A1 | 1/2004 | Torango | 463/25 |
| 2004/0023710 | A1 * | 2/2004 | McGahn et al. | 463/16 |
| 2004/0023716 | A1 * | 2/2004 | Gauselmann | 463/26 |
| 2004/0033831 | A1 * | 2/2004 | Tarantino | 463/22 |
| 2004/0038741 | A1 | 2/2004 | Gauselmann | 463/42 |
| 2004/0048644 | A1 | 3/2004 | Gerrard et al. | 463/16 |
| 2004/0087357 | A1 * | 5/2004 | Johnson | 463/17 |
| 2004/0087368 | A1 * | 5/2004 | Gauselmann | 463/42 |
| 2004/0092304 | A1 | 5/2004 | George | 463/29 |
| 2004/0180710 | A1 * | 9/2004 | Palmer et al. | 463/16 |
| 2004/0266534 | A1 * | 12/2004 | Byng | 463/42 |
| 2005/0003880 | A1 | 1/2005 | Englman | 463/16 |
| 2005/0055113 | A1 | 3/2005 | Gauselmann | 700/91 |
| 2005/0059467 | A1 | 3/2005 | Saffari et al. | 463/19 |
| 2005/0059472 | A1 | 3/2005 | Joshi et al. | 463/20 |
| 2005/0064930 | A1 | 3/2005 | Jubinville et al. | 463/17 |
| 2005/0096130 | A1 | 5/2005 | Mullins | 463/27 |
| 2005/0137010 | A1 | 6/2005 | Enzminger et al. | 463/25 |
| 2005/0192088 | A1 | 9/2005 | Hartman et al. | 463/27 |
| 2005/0215313 | A1 | 9/2005 | O'Halloran | 463/26 |
| 2006/0003829 | A1 | 1/2006 | Thomas | 463/20 |
| 2006/0019737 | A1 | 1/2006 | Yang | 463/19 |
| 2006/0025195 | A1 | 2/2006 | Pennington et al. | 463/16 |

| | | | | |
|---|---|---|---|---|
| 2006/0025210 | A1 | 2/2006 | Johnson | 463/25 |
| 2006/0030403 | A1 | 2/2006 | Lafky et al. | 463/27 |
| 2006/0052159 | A1 | 3/2006 | Cahill et al. | 463/27 |
| 2006/0073877 | A1 | 4/2006 | Rodgers et al. | 463/20 |
| 2006/0073889 | A1 | 4/2006 | Edidin et al. | 463/27 |
| 2006/0116201 | A1 | 6/2006 | Gausselmann | 463/26 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |
| 2006/0178203 | A1 | 8/2006 | Hughes et al. | 463/20 |
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | A | 8/1999 |
| WO | WO 99/03078 | A1 | 1/1999 |
| WO | WO 99/19037 | A1 | 4/1999 |
| WO | WO 01/33478 | A1 | 5/2001 |
| WO | WO 03/026754 | A1 | 4/2003 |
| WO | WO 03/083789 | A1 | 10/2003 |

OTHER PUBLICATIONS

Article for "Millioniser" by Glenn Haussman; Strictly Slots, pp. 50-53 (Mar. 2004).

Product Sheet for "Big Games Safari," IGT, 24 pages (2000).

"New '97 Games," International Gaming & Wagering Business, 24 pages (Mar. 1997).

International Search Report—PCT/US06/20979 dated Nov. 13, 2006 (2 pages).

* cited by examiner

WAGERING GAME WITH ENHANCED PROGRESSIVE GAME

CROSS REFERENCE TO RELATED APPLICATIONS

This application is a U.S. national phase of International Application No. PCT/US2005/017327, filed May 17, 2005, which claims the benefit of priority of U.S. Provisional Patent Application No. 60/639,952, filed Dec. 22, 2004, U.S. Provisional Patent Application No. 60/635,336, filed Dec. 10, 2004 and U.S. Provisional Patent Application No. 60/572,294, filed May 18, 2004, all of which are incorporated by reference in their entirety.

FIELD OF THE INVENTION

The present invention relates generally to gaming terminals and, more particularly, to a gaming terminal having a multi-level progressive game.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a progressive jackpot. In the gaming industry, a "progressive" involves collecting coin-in data from participating gaming device(s) (e.g., slot machines), contributing a percentage of that coin-in data to a jackpot amount, and awarding that jackpot amount to a player upon the occurrence of a certain jackpot-won event. The percentage of the coin-in is determined prior to any result being achieved and is independent of any result. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

In some current progressive games, the player is merely a spectator while the progressive jackpot is being awarded. This can lower the level of player excitement, because the player may feel as though he or she is not participating in the game.

In some progressive games, there are multiple levels of progressive jackpots or awards, which are designed to increase player excitement. However, in some of these games, the player can only win one of the levels of progressive jackpots. This can lower the level of player excitement if the player wins the smallest award, because the player is not going to win the larger level progressive award.

Thus, there is a need for increasing player excitement by improving wagering game formats that increase the feeling of control a player has over the progressive game.

Also, there is a need for increasing player excitement by allowing a player to win multiple progressive jackpots in a single turn.

SUMMARY OF THE INVENTION

In one embodiment of the present invention, the needs mentioned above are met by a method of playing a wagering game that has a basic game and a multi-level secondary game. The present invention does so by conducting the basic game at a gaming terminal and achieving a first-level secondary game entry award at the gaming terminal. In response to achieving the first-level secondary game entry award, a first-level secondary game is activated. A first set of player-selectable game elements is then displayed. At least one player-selectable game element is chosen, via player inputs, and the player-selectable game elements include a second-level secondary game entry award. When the second-level secondary game is achieved, a second-level secondary game is activated, and a second set of player-selectable game elements is displayed. At least one of the second set of player-selectable game elements is then selected via player inputs and a progressive game payoff is awarded based on the selecting.

In accordance with another embodiment of the present invention, a gaming terminal includes a wagering game having a plurality of symbols that indicate a randomly selected outcome of the wagering game and a secondary game. In response to the randomly selected outcome being a start-secondary game outcome, the gaming terminal displays a plurality of player-selectable game elements whose symbols are revealed as selected by a player. The plurality of player-selectable game elements includes at least one of a stop-game element, an award element, and a continue-game element. The ratio of the number of stop-game elements to continue-game elements is dependant on an amount wagered during the wagering game.

In accordance with another embodiment of the present invention, a gaming system includes a gaming terminal for playing a special-event game, the gaming terminal having a display. Signage that is related to the special event is coupled and located proximate to the gaming terminal. The signage has a signage display. The special-event game is simultaneously displayed on the display of the gaming terminal and on the signage display of the signage. However, the signage display displays an altered version of the special-event game.

In accordance with yet another embodiment of the present invention, a method of playing a wagering game is provided. The wagering game includes a basic game and a secondary game. The method includes conducting the basic game at a gaming terminal and achieving a secondary game entry award at the gaming terminal. In response to achieving the secondary game entry award, a secondary game is activated. A set of player-selectable game elements is displayed during the secondary game, and the player selects at least one. The player-selectable game elements include at least one progressive-game-award symbol and at least one credit-award symbol. In response to the player selecting the at least one progressive-game-award symbol, a progressive game award is awarded. If the player selects the at least one credit-award symbol, an award corresponding to the credit award symbol is awarded. However, if both the at least one credit-award symbol and the at least one progressive game-award symbol are selected, the player is then awarded both the progressive game award and the award corresponding to the credit-award symbol.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
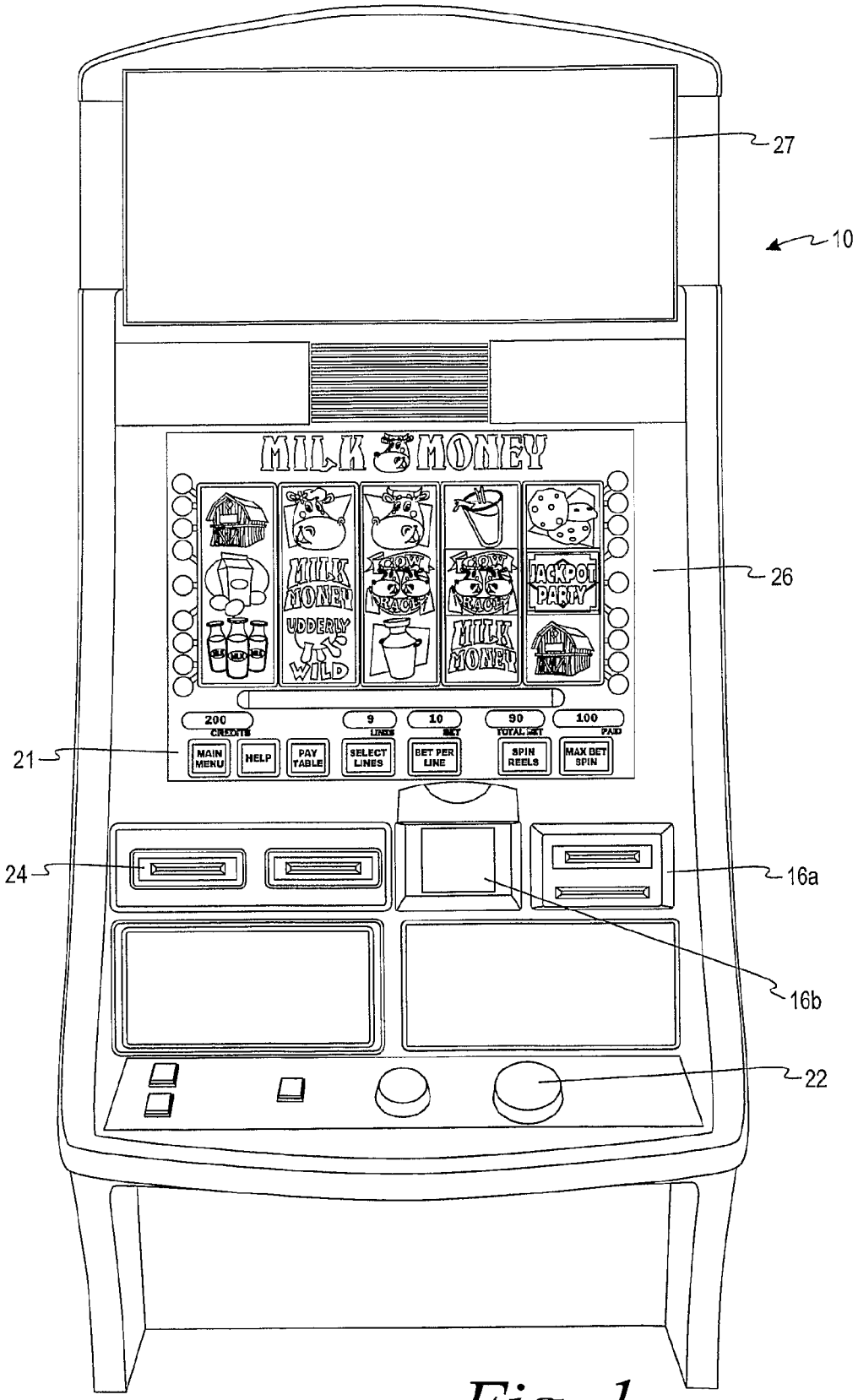
FIG. 1 is a perspective view of a video gaming terminal according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a perspective view of a typical gaming terminal 10 used by gaming establishments, such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play video slots or a video casino game, such as blackjack, slots, keno, poker, etc.

As shown, the gaming terminal 10 includes input devices, such as a wager acceptor 16 (shown as a card wager acceptor 16*a* and a cash wager acceptor 16*b*), a touch screen 21, a push-button panel 22, and a player-identification card reader 24. For outputs, the gaming terminal 10 includes a main display 26 for displaying information about the basic wagering game, and a secondary display 27 that may display an electronic version of a pay table, and/or also possibly game-related information or other entertainment features. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The cash wager acceptor 16*a* may include a coin slot acceptor or a note acceptor to input value to the gaming terminal 10. The card wager acceptor 16*b* may include a card-reading device for reading a card that has a recorded monetary value with which it is associated. The card wager acceptor 16*b* may also receive a card that authorizes access to a central account, which can transfer money to the gaming terminal 10.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The outcome of the basic wagering game is displayed to the player on the main display 26. The main display 26 may take the form of a cathode ray tube (CRT), a high resolution LCD, a plasma display, LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome, as long as it includes the secondary display 27 for displaying the bonus game feature described below.

The player-identification card reader 24 allows for the identification of a player by reading a card with information indicating his or her true identity. Currently, the identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10. The gaming terminal 10 may use the secondary display 27 for providing the player with information about his or her account or other player-specific information.

Figure 2:
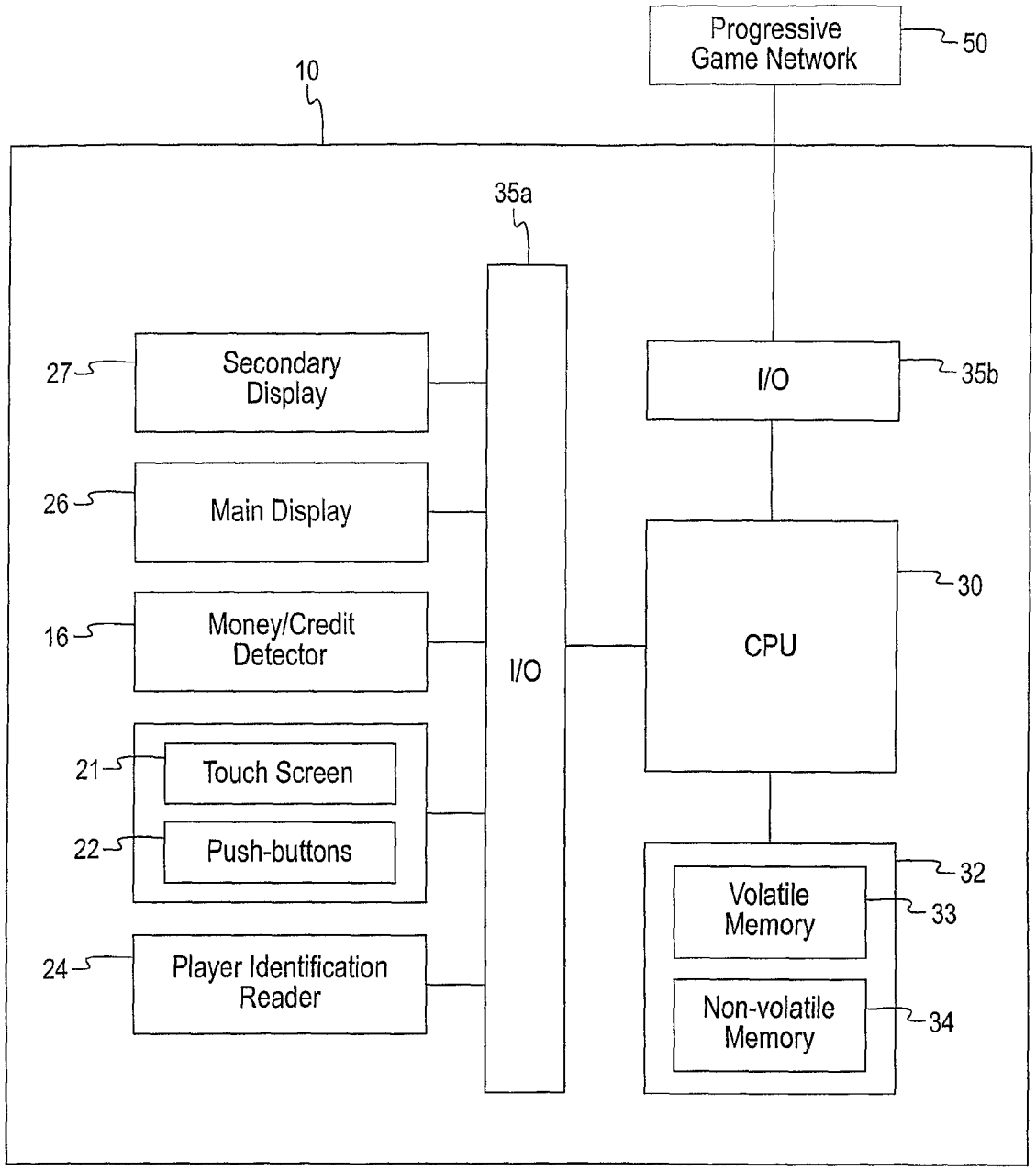
FIG. 2 is a block diagram of the gaming terminal of FIG. 1.

As shown in FIG. 2, the various components of the gaming terminal 10 are controlled by a central processing unit (CPU) 30 (such as a microprocessor or microcontroller). To provide the gaming functions, the CPU 30 executes a game program that allows for the randomly selected outcome. The CPU 30 is also coupled to or includes a system memory 32. The system memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the memory 32 may include multiple RAM and multiple program memories.

Communications between the peripheral components of the gaming terminal 10 and the CPU 30 occur through input/ output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

In some embodiments, the CPU 30 may not be inside the gaming terminal 10. Instead, the CPU 30 may be part of a progressive game network 50 (FIG. 2) and may be used to control numerous gaming terminals 10. In these embodiments, the CPU 30 will run the basic games for each of the gaming terminals 10, and may also be used to link the gaming terminals 10 together. The gaming terminals 10 may all be part of a progressive game network. The progressive game network can include progressive jackpots that are contributed to by all or some of the gaming terminals 10 in the network. For example, the gaming terminals may have four levels of progressive jackpots: a terminal-level jackpot, that is unique to each terminal 10, a bank-level jackpot that every terminal 10 in a particular bank of terminals 10 contributes to, a first wide-area jackpot that is contributed to by multiple banks of terminals 10, or is even casino wide; and a second wide-area jackpot that multiple casinos participate in.

Figure 3:
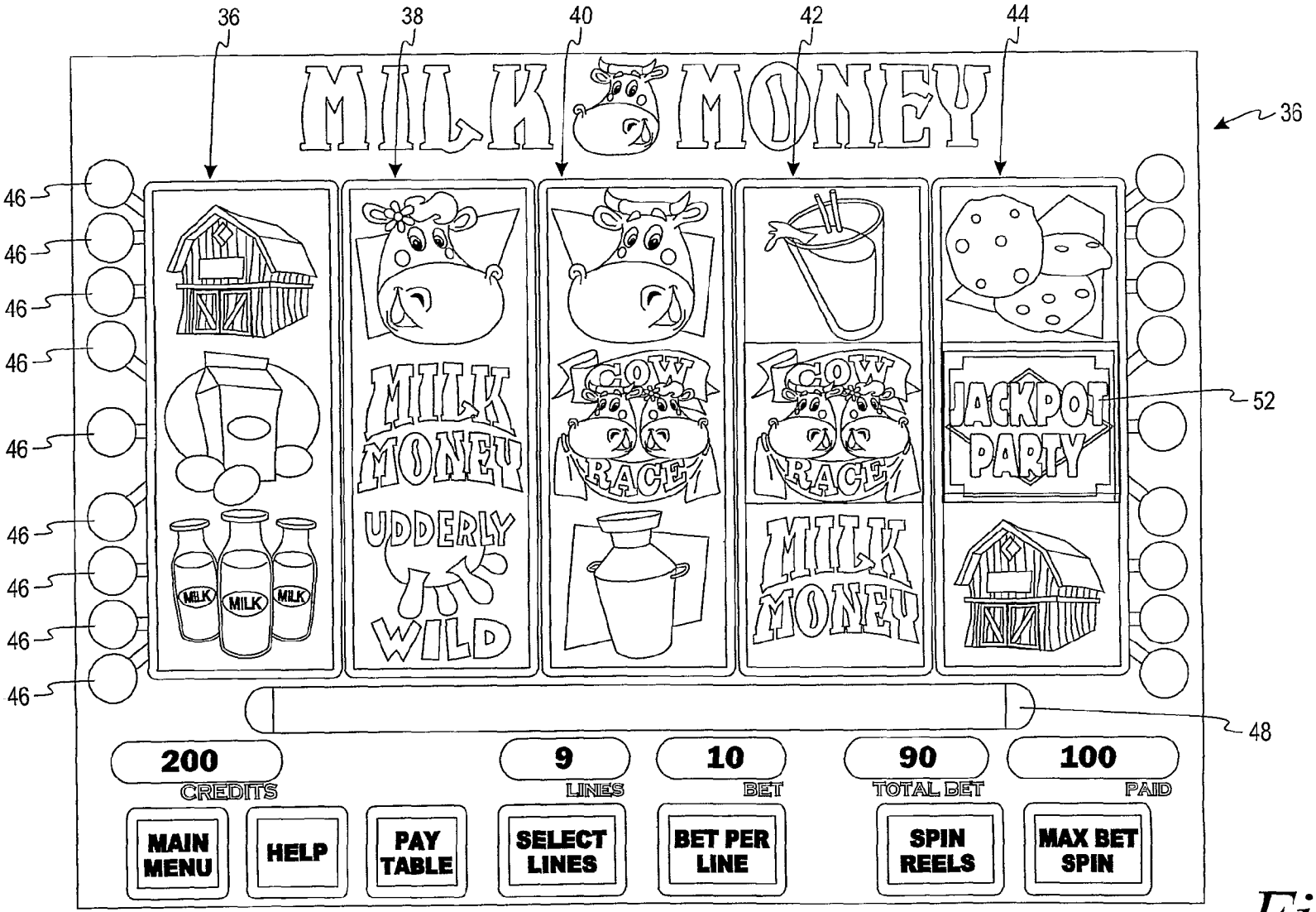
FIG. 3 illustrates a display of a basic game on the gaming terminal of FIG. 1.

Turning now to FIG. 3, the main display 26 of one embodiment of the present invention is shown in more detail. In this embodiment, the basic game is a slot machine game, with symbols on five different reels 36, 38, 40, 42, 44. The reels 36-44 may be either traditional mechanical reels or they may be computer-generated images of reels, with each reel composed of a plurality of symbols. The payline indicators 46 indicate a randomly selected outcome for each payline, which is the combination of symbols on the reels 36-44. Thereafter, an outcome indicator 48 indicates whether the outcome has resulted in a payout, a progressive jackpot, a bonus game, or whether it resulted in nothing. While multiple paylines are shown, a gaming terminal 10 with a single payline will also work with the present invention.

In the present example, the wagering game follows the theme of a dairy farm, where the symbols represent different things generally associated with milking cows (e.g., farmers, barns, pails of milk, cows, milk bottles, etc. . . . ). Various combinations of the symbols can result in prizes, including monetary and non-monetary prizes. The non-monetary prizes include free spins, multipliers, entry into a bonus game, entry into a progressive game, etc.

In this particular embodiment, as shown in FIG. 3, a particular symbol, or group of symbols, generates entry into a progressive game. The game enters the progressive stage when a particular symbol is present in any of the reels 36, 38, 40, 42, and 44. In this embodiment, the progressive-game entry symbol is a "jackpot party" symbol 52 shown in the fifth reel 44, on an actual payline played by the player. In other embodiments, other symbols and/or symbol combinations (including symbols on other reels) may trigger the bonus game.

Figure 4:
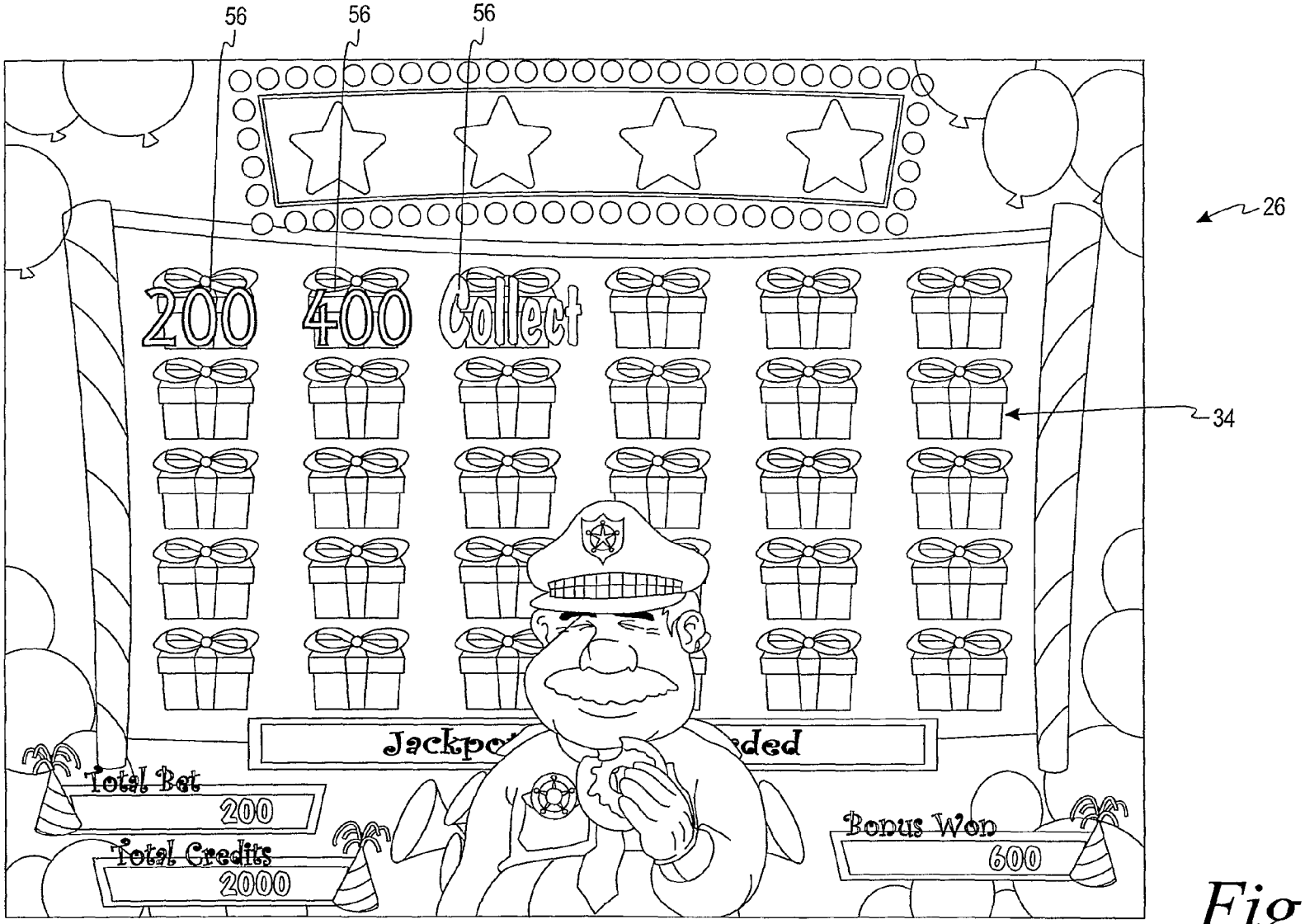
FIG. 4 illustrates an initial progressive game screen on the gaming terminal of FIG. 1.

Turning now to FIG. 4, a display of the progressive game is shown that is triggered by the progressive-game entry symbol in the basic game, as shown in FIG. 3. In this embodiment, the progressive game includes a number of presents 54 arranged in an array on the main display 26. After the player selects one of the presents 54, either by pressing the present 54 on the touch screen 21 (FIGS. 1 and 2) or by giving the coordinates of the present 54, the selected present 56 opens and reveals its contents to the player. In the illustrated embodiment, the player selected three presents 56, the first two awarding credit amounts, and a third that reveals the word "collect." In other embodiments, the awards can be non-monetary awards such as free spins or multipliers. The "collect" symbol is a progressive game-ending symbol, and effectively ends the progressive round for the player. The player is then awarded the total amount of the number of credits or other awards that were revealed prior to choosing the collect prize.

Figure 5:
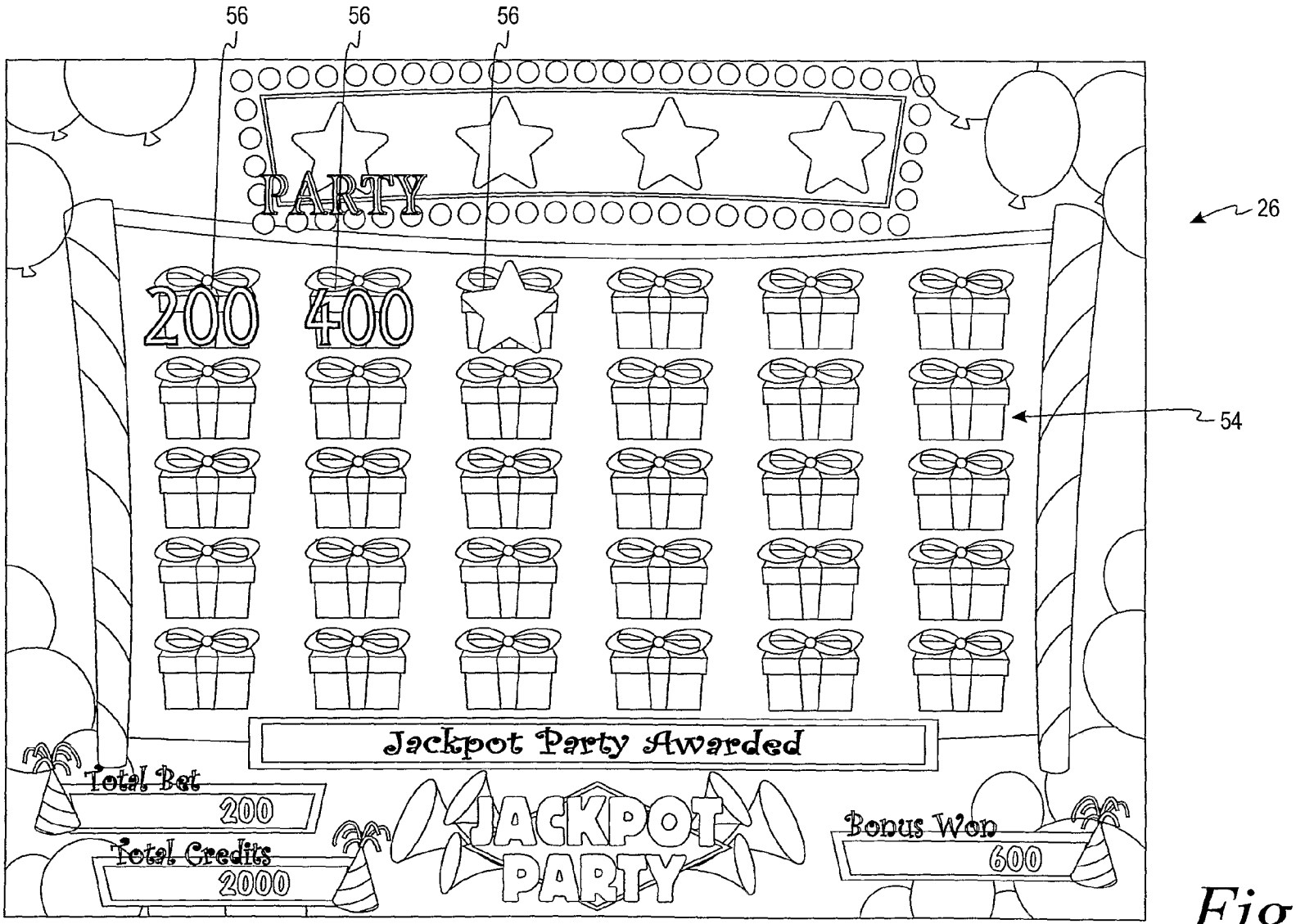
FIG. 5 illustrates another progressive game screen on the gaming terminal of FIG. 1.

Turning now to FIG. 5, another outcome is illustrated. In this progressive game, the player has selected the same three presents, but in this embodiment, the third present selected reveals a "star" symbol, or a continue-game element or symbol, which causes the player to jump to the next level progressive. When the player achieves a continue-game element, the player is awarded the amount of credits from the selected presents in this case 600 credits, plus the progressive amount for the first level, and then is given a new array of presents to begin selecting for more prizes. In other embodiments, there may only be a single level in the secondary game and when the player achieves the "star" symbol, the player is awarded the progressive and any credits achieved, and then the secondary game ends.

In one embodiment, there are four levels of progressives, with each level offering a progressive jackpot that is larger than the previous level. At each of the first three levels, the player is given a chance to advance to the next higher level. At the final level, if the player achieves the "star" or continue-game symbol, the player is awarded the final and largest progressive jackpot.

In some embodiments, each level progressive game is linked to a different gaming terminal or set of terminals. For example, the first level progressive jackpot may be specific to each individual gaming terminal (i.e., a terminal level progressive). The second level progressive jackpot may be a bank-level progressive, meaning that all the gaming terminals in a particular bank (e.g., four or five adjacent terminals) contribute and are eligible to win. The third level progressive jackpot may be a wide-area progressive, such as a multi-bank progressive or a casino-wide progressive. The fourth level progressive jackpot may also be a wide-area progressive, but one that is larger than the third, e.g., a casino-wide progressive or a state-wide progressive.

In some embodiments, the number of end-game symbols and continue-game symbols may be varied depending upon the wager made by the player. For example, Table 1, shown below, provides one example of how the amount of the initial wager in the basic game shown in FIG. 3 may vary the number of "stars" (continue-game symbols) and "poopers" (end-game symbols). In other embodiments, the number of "stars" and "poopers" may be constant or the number of "stars" and "poopers" may be randomly varied regardless of the amount wagered. In some embodiments, the number of "stars" and "poopers" may also vary depending on which progressive level the player is in. For example, there may be four "stars" to one "pooper" in the first-level progressive game, but in the second-level; there may be only three "stars," and three "poopers."

TABLE 1

| Wager | Stars | Poopers |
|---|---|---|
| 40 | 1 | 4 |
| 80 | 2 | 3 |
| 120 | 3 | 2 |
| 160 | 4 | 1 |
| 200 | 5 | 0 |

Table 2 illustrates how the number of "stars" and "poopers" is varied for wager levels that fall between the set wager amounts.

TABLE 2

| Wager | Stars | Poopers | Chance at Extra Star | Chance at Extra Pooper |
|---|---|---|---|---|
| 41 | 1 | 3 | 1/40 | 39/40 |
| 42 | 1 | 3 | 2/40 | 38/40 |
| 43 | 1 | 3 | 3/40 | 37/40 |
| 44 | 1 | 3 | 4/40 | 36/40 |

The above tables were related to a particular embodiment, where the progressive game relates to an arrangement of packages. In other embodiments, the progressive game could be other indicia, such as reel symbols from a standard slot machine or cards from a deck of cards.

Figure 6:
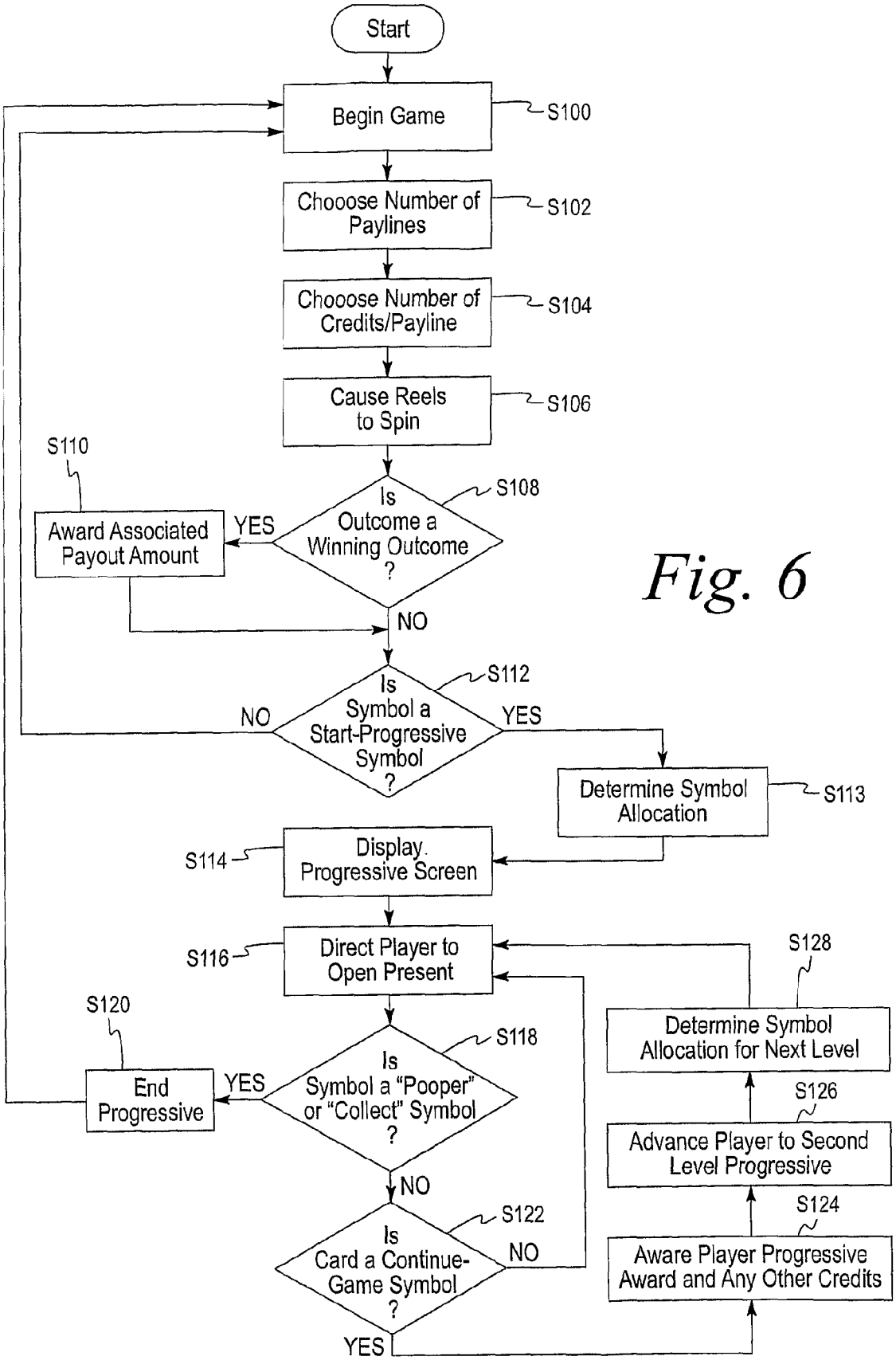
FIG. 6 is a flow chart describing the method of playing the bonus game.

Turning now to FIG. 6, the operation detailing the method of playing the game according to the illustrated embodiment of the invention will be described. In step s100, a player at the gaming terminal 10 begins a gaming session by any conventional method (e.g., inserting coins or using credits). The gaming terminal 10 has a basic wagering game that involves a player making various inputs, including, for example, choosing a number of paylines to play (step s102). In some embodiments, there are a maximum of nine paylines, as shown in the gaming terminal 10 of FIG. 1. In other embodiments, there may only be a single payline. In those embodiments, this step would be skipped. After choosing how many paylines to play, the player selects how many credits (e.g., 1-5) to wager on each payline (step s104).

Regarding eligibility for the progressive game, in some embodiments, the player is only eligible for the progressive game if the player chooses to play all of the paylines and/or the player wagers the maximum amount on each of the paylines played. In other embodiments, the player is automatically eligible for the progressive game, and is not required to make a minimum wager or to play a minimum number of lines. In some other embodiments, there is a "side-wager" option that allows the player to be eligible for the bonus game. The "side-wager" option is described in U.S. patent application Ser. No. 10/659,878, filed on Sep. 11, 2003, entitled "Gaming Machine With Multi-Level Progressive Jackpot," which is commonly owned and herein incorporated by reference in its entirety.

At step s106, the player begins the basic wagering game, thereby causing the reels to spin and display a symbol combination that corresponds to the randomly selected outcome from the CPU 30 (FIG. 2). At step s108, it is determined if the randomly selected outcome (i.e., arrangement of symbols) is one of the winning outcomes according to a basic-game pay table (not shown). If the answer is "yes," then the gaming system progresses to step s110, and awards the player with the associated payout amount.

If the answer at step s108 is "no," or, after the payout has been awarded at step s110, then the gaming terminal 10 determines whether any of the symbols is a start-progressive game symbol, which is associated with entering a progressive game (step s112). If the answer is "no", the game returns to step s100 and the game begins again.

If one of the symbols the randomly selected outcome is a start-progressive game symbol that causes entry to the progressive game, then terminal advances to step s113, and the allocation of the symbols (as described above in reference to Tables 1 and 2) is determined based on the players selections at steps s102 and s104. The game then progresses to step s114, and the progressive game screen is displayed. As stated above in reference to FIG. 4, the progressive game is set up as an array of presents 54. The player is then directed to select a present (step s116), which is then opened to reveal the contents of the present (the selected present 56 of FIG. 4). In this embodiment, the array of presents 54 include game-ending symbols, value-adding symbols (e.g., credits and free spins), and continue-game symbols. If the card is a game-ending symbol such as "pooper" or a "collect" symbol (step s118), the game continues to step s120 and the player is awarded any credits or other awards achieved during the progressive game. The progressive game is now complete.

If the card is not a game-ending symbol such as a "pooper" or a "collect" symbol, the progressive game continues to step s122, at which the symbol is analyzed to determine whether it is a continue-game symbol, which takes the player to the next level of the progressive game. If it is not a continue-game symbol, the player is directed to select another present to open (step s116).

If the symbol is a continue-game symbol, the player is awarded any credits or other awards achieved during the progressive game and the first level progressive amount (step s124). The player then advances to a second-level progressive game (step s126), and a new array of presents is displayed (s116), whose symbols are determined at s128 depending on the decisions made by the player at steps s102 and s104. The game progresses the same as the first-level progressive game, except that if the player selects a "star," then the player is awarded the second-level progressive and proceeds to the third level progressive game. This continues until the player either selects a "pooper" or a "star" in the highest level progressive. Once the player selects a "pooper," the game ends as described above. If the player selects a "star" at the highest level progressive, then the player is awarded the highest progressive jackpot, and the progressive game ends, returning the player to the beginning of the game.

In some embodiments, when the player advances to the second-level progressive game, the player is awarded all the credits earned from the open presents in the first level as well as the first-level progressive jackpot. In other embodiments, if a player achieves the second-level progressive jackpot, the first-level jackpot is forfeited for the larger, second-level jackpot.

In other embodiments, the first level of the progressive game does not include a progressive jackpot. Instead, the first level acts as a qualifying round. In the first level of these embodiments, the "star" or continue-game element does not award the player a progressive jackpot. Instead, revealing the "star" advances the player to the second level of the progressive game, which includes a progressive jackpot. The first level may include presents 56 that reveal credits or other non-monetary awards and also "poopers" or other game-ending symbols. As in the above-described embodiments, the player selects the presents 56 until he or she obtains either the "star" or the "pooper." If the player has achieved credits prior to revealing the "star" or "pooper" symbol, the player may be awarded the total amount of those credits.

Figure 7:
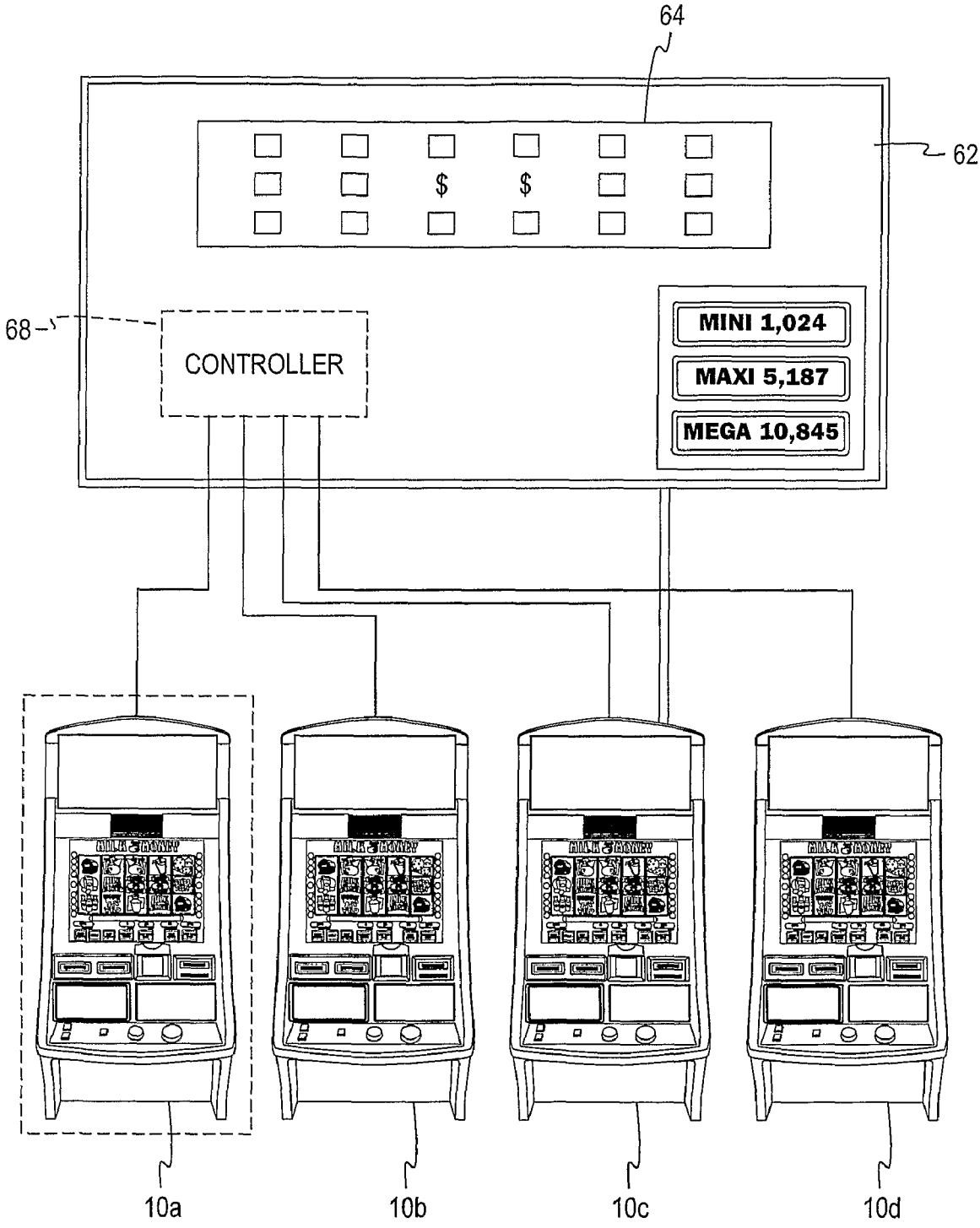
FIG. 7 illustrates a gaming system according to one embodiment of the present invention.

Turning now to FIG. 7, a gaming system 60 of gaming machines 10*a*, 10*b*, 10*c*, 10*d* is shown. The four gaming machines 10*a*, 10*b*, 10*c*, 10*d* are of the type described above in relation to FIGS. 1 and 2. The four gaming machines 10*a*, 10*b*, 10*c*, 10*d* are interconnected and located near signage 62. The signage 62 includes at least one jackpot screen 64 displaying a plurality of dollar amounts for a multi-level progressive payout or progressive jackpot. In this embodiment, there are three dollar amount levels: a Mini Jackpot, a Maxi Jackpot, and a Mega Jackpot. In other embodiments, there may be any number of progressive jackpots.

The jackpot screen 64 also alerts the players at the gaming terminals 10*a*, 10*b*, 10*c*, 10*d* when one of the players at a gaming terminal initiates the progressive game described above. While the progressive game is being played at the gaming terminal, the jackpot screen 64 also displays the progressive game. However, the jackpot screen 64 does not exactly duplicate the main display 26 of the gaming terminal. Instead, the jackpot screen 64 will alter the information shown on the main display 26 in the following ways: delete certain information; add other information; and/or substitute information.

In some situations, the jackpot screen 64 will delete certain portions of the screen as shown on the main display 26 of the gaming terminal 10. One purpose for deleting or omitting information may be to preserve the player's privacy, such as credits wagered, credits remaining, etc. . . . For example, as shown in FIG. 4, the information along the bottom of the main display 26 such as a credit meter indicating the total number of credits that the player has at any given time may be deleted from the jackpot screen 64. Also, while the gaming terminal is waiting for the player to make a selection, the presents may jiggle or somehow be animated. The jackpot screen 64 may delete this portion of the display, and show the presents as stationary during play of the progressive game. The jackpot screen 64 may also delete player identification information that may be included on the main display 26.

In other embodiments, information is added. For example, when a player wins a progressive jackpot, the main display 26 of the gaming terminal may show some animation with a star. When this occurs, the jackpot screen 64 will show much more animation and may include sound. This is to draw people's attention to the fact that someone has won one of the progressive jackpots. Another example of added information may be a portion of the screen that is dedicated to the amounts of the progressive jackpots. On the jackpot screen, the progressive jackpot "tickers" or amounts will be updated in real-time to show how much each is worth. Another example may be animation that is added to the presents on the jackpot screen 64 in order to draw attention to the game being played and to lure more players to the gaming terminals.

In other embodiments, information from the main display 26 is replaced with different information on the jackpot screen 64. When a player wins a credit amount in the progressive game (as illustrated in FIG. 4), the main display 26 of the gaming terminal illustrates to the player exactly how many credits was won. To protect the player's privacy, the jackpot screen 64 only shows a symbol, such a dollar sign, indicating that the player has won a credit amount—instead of showing exactly how much the player has won. Also, when one of the progressive jackpots is won, the main display 26 of the gaming terminal will show the player the amount of the progressive jackpot won, plus any credits won also. The jackpot screen 64 will only show the amount of the progressive jackpot won and may substitute a symbol such as a dollar sign for the amount of credits won, or it may not show that information at all.

The signage 62 may include a signage controller 68 that is connected to each of the four gaming machines 10*a*, 10*b*, 10*c*, 10*d*. The signage controller 68 transmits information to and receives information from the CPU 30 (FIG. 2) in each of the four gaming machines 10*a*, 10*b*, 10*c*, 10*d* throughout the game. The gaming system 60 allows for various aspects of the gaming machines 10*a*, 10*b*, 10*c*, 10*d*, such as updating the progressive jackpots to be controlled through the signage controller 68 in the signage 62. Also the signage controller 68 may control how information is displayed on the jackpot screen 64.

Alternatively, the jackpot screen 64 may be controlled by the individual CPU 30. As described above in reference to FIG. 2, the CPU 30 may be located in each of the gaming terminals 10*a*, 10*b*, 10*c*, 10*d* or it may be located remotely from the gaming terminals, or be a part of the network 50.

In another embodiment, the gaming terminal 10 and jackpot screen 64 may also utilize different accompanying audio programs that are paired with the different displays. The more elaborate animation on the jackpot screen 64 may be accompanied by a more intense audio soundtrack.

In another embodiment, the jackpot screen 64 may replay previously played progressive games in order to attract new players to the gaming terminals 10*a*, 10*b*, 10*c*, 10*d*. In this embodiment, progressive games that result in a player winning a progressive jackpot may be saved in a memory, such as the system memory 32 or in a memory (not shown) outside of the gaming terminal. During times when there is not a progressive game being played on the bank of gaming terminals 10*a*, 10*b*, 10*c*, 10*d* and/or when there is an opening at one of the gaming terminals 10*a*, 10*b*, 10*c*, 10*d*, the jackpot screen 64 will replay exciting jackpot wins. In some versions, the entire progressive game will be replayed, in others, only the winning portions or other exciting portions of the progressive game may be replayed. In other embodiments, portions of multiple progressive games may be edited together to create a "highlight" reel. By replaying exciting moments in the games, new players may feel as though they want to be a part of the excitement and may join in playing the game.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A gaming system comprising:

a gaming terminal for playing a special-event game, the gaming terminal having a display; and a signage that is related to the special event game and is coupled to a plurality of gaming terminals including the gaming terminal and is located proximate to the gaming terminal, the signage having a signage display that displays images from any of the plurality of gaming terminals;

wherein an identical first image of the special-event game having a plurality of image elements is simultaneously displayed on the display of the gaming terminal and the signage display, and after receiving a player input related to one of the image elements, changing one of the plurality of image elements to an alpha-numeric element on the display of the gaming terminal, wherein a second image of the special-event game having the identical plurality of image elements as the first image except for the alpha-numeric element is displayed on the display of the gaming terminal and the signage display simultaneously displays an altered version of the second image of the special-event game including the identical plurality of image elements identical to the first image except that the changed one of the plurality of image elements corresponding to the alpha-numeric element displayed on the gaming terminal is changed to a non-alpha-numeric format.

2. A gaming system comprising:

a gaming terminal including an input device and a terminal display device;

a signage display device external and coupled to the gaming terminal; and at least one memory device which stores a plurality of instructions which, when executed by at least one processor, cause the at least one processor to operate with the input device, the terminal display device, and the signage display device to:

receive a wager;

initiate a special event game including an array of selectable elements;

display the array of selectable elements on the terminal display device;

display the same array of selectable elements on the signage display device; and in response to selection of one or more of the selectable elements in the array, reveal, on the terminal display device, awards in a numeric format proximate the respective one or more selected elements and reveal, on the signage display device, the awards in a non-numeric format, but not the numeric format, proximate the respective one or more selected elements.

3. The gaming system of claim 2, wherein the array of selectable elements includes multiple rows and multiple columns.

4. The gaming system of claim 2, wherein the awards in the numeric format include credit amounts.

5. The gaming system of claim 4, wherein the awards in the non-numeric format include symbols indicative that credit amounts have been won.

6. The gaming system of claim 2, wherein the awards in the numeric format and the non-numeric format are simultaneously displayed on the respective terminal display device and the signage display device.

7. The gaming system of claim 2, wherein the gaming system includes a plurality of gaming terminals including the gaming terminal.

8. A computer-implemented method in a gaming system including a gaming terminal and a signage display device, the gaming terminal including an input device and a terminal display device, the signage display device being external and coupled to the gaming terminal, the method comprising:

receiving a wager via the input device;

initiating, by one or more processors, a special event game including an array of selectable elements;

displaying the array of selectable elements on the terminal display device;

displaying the same array of selectable elements on the signage display device; and in response to selection of one or more of the selectable elements in the array, revealing, on the terminal display device, awards in a numeric format proximate the respective one or more selected elements and revealing, on the signage display device, the awards in a non-numeric format, but not the numeric format, proximate the respective one or more selected elements.

9. The computer-implemented method of claim 8, wherein the array of selectable elements includes multiple rows and multiple columns.

10. The computer-implemented method of claim 8, wherein the awards in the numeric format include credit amounts.

11. The computer-implemented method of claim 10, wherein the awards in the non-numeric format include symbols indicative that credit amounts have been won.

12. The computer-implemented method of claim 8, wherein the awards in the numeric format and the non-numeric format are simultaneously displayed on the respective terminal display device and the signage display device.

13. The computer-implemented method of claim 8, wherein the gaming system includes a plurality of gaming terminals including the gaming terminal.

14. One or more machine-readable storage media including instructions which, when executed by one or more processors, cause the one or more processors to perform operations comprising:

receiving a wager via an input device of a gaming terminal;

initiating a special event game including an array of selectable elements;

displaying the array of selectable elements on a terminal display device of the gaming terminal;

displaying the same array of selectable elements on a signage display device, the signage display device being external and coupled to the gaming terminal; and in response to selection of one or more of the selectable elements in the array, revealing, on the terminal display device, awards in a numeric format proximate the respective one or more selected elements and revealing, on the signage display device, the awards in a non-numeric format, but not the numeric format, proximate the respective one or more selected elements.

15. The storage media of claim 14, wherein the array of selectable elements includes multiple rows and multiple columns.

16. The storage media of claim 14, wherein the awards in the numeric format include credit amounts.

17. The storage media of claim 16, wherein the awards in the non-numeric format include symbols indicative that credit amounts have been won.

18. The storage media of claim 14, wherein the awards in the numeric format and the non-numeric format are simultaneously displayed on the respective terminal display device and the signage display device.

19. The storage media of claim 14, wherein the gaming system includes a plurality of gaming terminals including the gaming terminal.

20. A gaming system comprising:

a gaming terminal including an input device and a terminal display device;

a signage display device external and coupled to the gaming terminal; and at least one memory device which stores a plurality of instructions which, when executed by at least one processor, cause the at least one processor to operate with the input device, the terminal display device, and the signage display device to:

receive a wager;

initiate a special event game including an array of selectable elements;

display the same array of selectable elements on both the terminal display device and the signage display device; and in response to selection of one or more of the selectable elements in the array, reveal awards proximate the respective one or more selected elements, the one or more awards being displayed on the terminal display device in a numeric format and being displayed on the signage display device in a non-numeric, but not the numeric, format.

21. The gaming system of claim 20, wherein the array of selectable elements includes multiple rows and multiple columns.

22. The gaming system of claim 20, wherein the awards in the numeric format include credit amounts.

23. The gaming system of claim 22, wherein the awards in the non-numeric format include symbols indicative that credit amounts have been won.

24. The gaming system of claim 20, wherein the awards in the numeric format and the non-numeric format are simultaneously displayed on the respective terminal display device and the signage display device.

25. The gaming system of claim 20, wherein the gaming system includes a plurality of gaming terminals including the gaming terminal.

* * * * *